US005671784A

United States Patent [19]

Dewispelaere

[11] Patent Number: 5,671,784

[45] Date of Patent: Sep. 30, 1997

[54] THREE-POSITION OPEN-SHED JACQUARD MACHINE

[75] Inventor: Andre Dewispelaere, Kortrijk/Marke, Belgium

[73] Assignee: N.V. Michael Van de Wiele, Kortrijk/Marke, Belgium

[21] Appl. No.: 585,930

[22] Filed: Jan. 16, 1996

[30] Foreign Application Priority Data

Jan. 17, 1995 [BE] Belgium ..... 09500038

[51] Int. Cl.[6] ..... D03C 3/12; D03C 3/20; D03C 3/06

[52] U.S. Cl. ..... 139/455; 139/65

[58] Field of Search ..... 139/455, 65, 21, 139/59

[56] References Cited

U.S. PATENT DOCUMENTS

| | | | |
|---|---|---|---|
| 4,532,963 | 8/1985 | Bastion et al. | 139/59 |
| 4,739,806 | 4/1988 | Palau et al. | 139/455 |
| 4,969,490 | 11/1990 | Seiler | 139/455 |
| 5,038,837 | 8/1991 | Palau et al. | 139/65 |
| 5,092,369 | 3/1992 | Derudder | 139/65 |
| 5,309,952 | 5/1994 | Speich | 139/455 |
| 5,363,884 | 11/1994 | Migliorini et al. | 139/455 |

FOREIGN PATENT DOCUMENTS

| | | | |
|---|---|---|---|
| 408076 | 1/1991 | Belgium . | |
| 0 330 624 | 8/1989 | European Pat. Off. | 139/455 |
| 2287539 | 5/1976 | France . | |
| 108700 | 5/1984 | France . | |
| 2587046 | 3/1987 | France . | |
| 399930 | 11/1990 | France . | |
| 4101778 | 4/1992 | Germany . | |
| 3264942 | 11/1988 | Japan | 139/455 |

*Primary Examiner*—Andy Falik
*Attorney, Agent, or Firm*—James Creighton Wray

[57] ABSTRACT

A three-position open-shed jacquard machine has a system with two interacting hooks (1), (2) for lifting a warp thread on a weaving loom. First and second knives (10), (11) are movable up and down in counterphase and in their bottom dead-center position can carry along a respective hook (1), (2) from a selection height (S). A first control element (20) selects each hook (1), (2) so that it can be carried along by the first and second knives (10), (11). Third and fourth knives (12), (13) are movable up and down in counterphase and in their top dead center position carry along a respective hook (1), (2), from the selection height (S). A second control element (21) selects each hook (1), (2) so that it is retained at the selection height (S). A hook (1), (2) which has not been selected by either of the two control elements (20), (21) is carried along by the third and fourth second knives (12), (13). The first and second knives (10), and third and fourth knives (11), (12), (13) interacting with the same hook (1), (2) move in counterphase. The control elements (20), (21) are positioned one below the other, and only one lifter element (6) is required. The hooks (1), (2) can be carried along smoothly from a stationary position by the respective knives (10), (11); (12), (13).

15 Claims, 7 Drawing Sheets h
+h
S
-h
B
M
O
1
2
3
4
5
6
7
8
9
10
11
12
13
14a
14b
15a
15b
16a
16b
17a
17b
19
20
21
22
23 h
10
11
12
13
14a
14b
15a
15b
16a
16b
17a
17b
19
20
21
1
2
3
4
5
6
7
8
9
B
M
O

FIG. 3
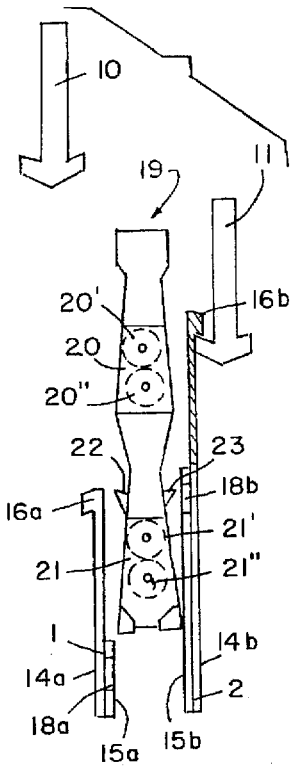
FIG. 4
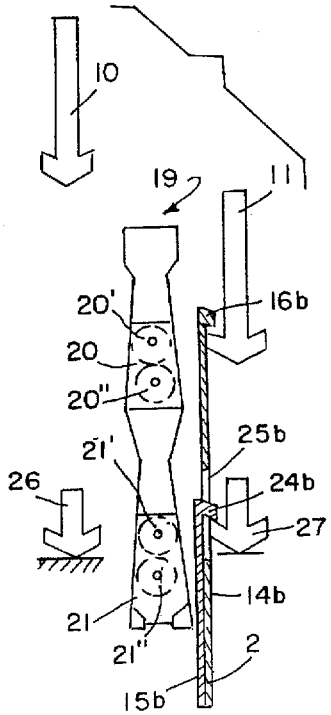
FIG. 5
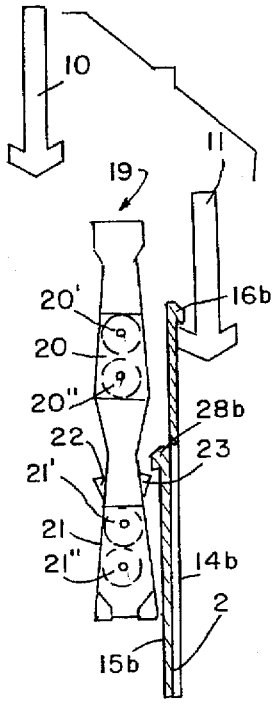
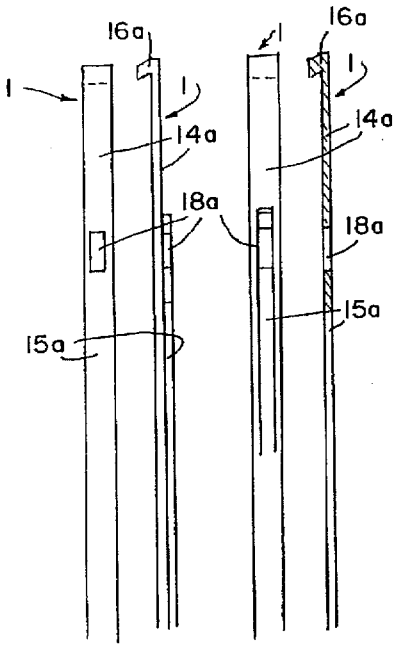
FIG. 6
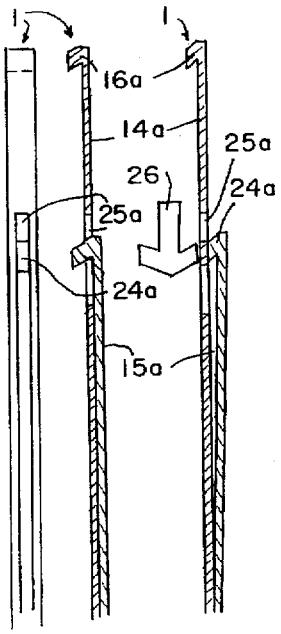
FIG. 7
FIG. 8
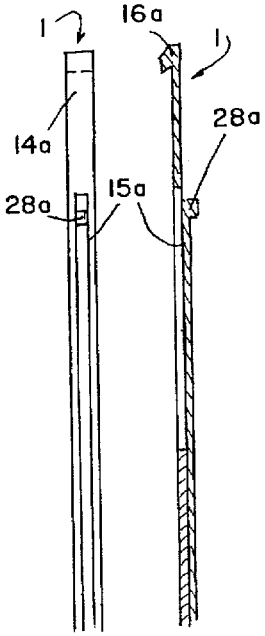
FIG. 9

FIG. 10A
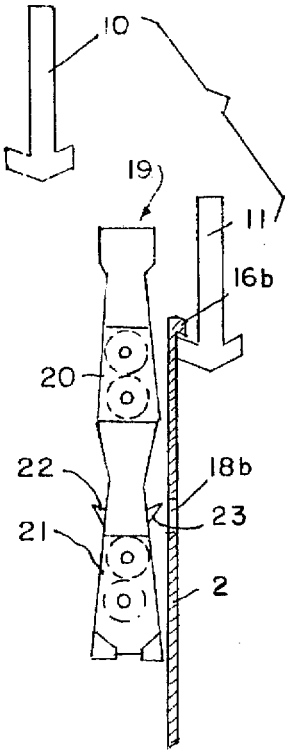
FIG. 10B
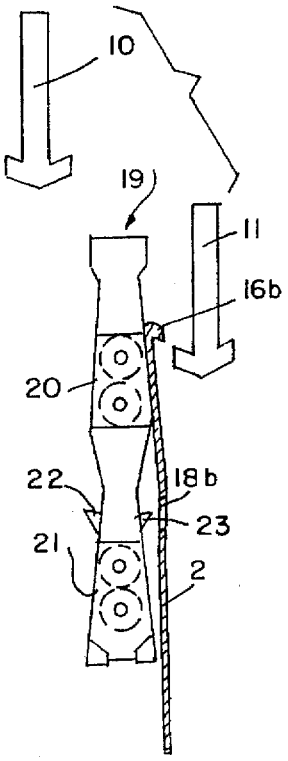
FIG. 10C
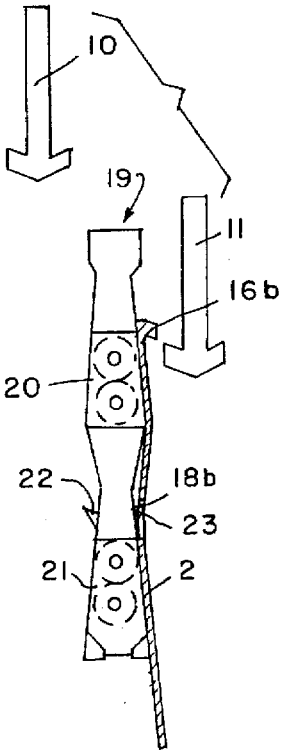
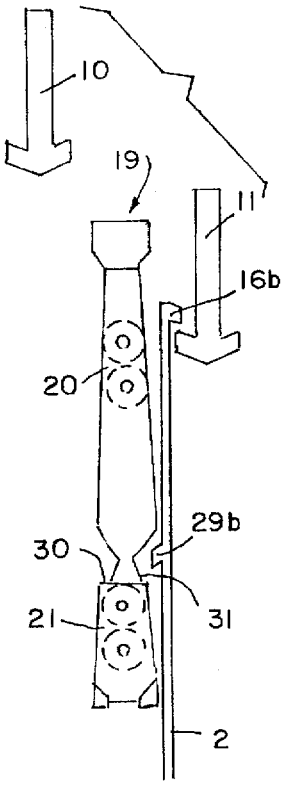
FIG. 11A
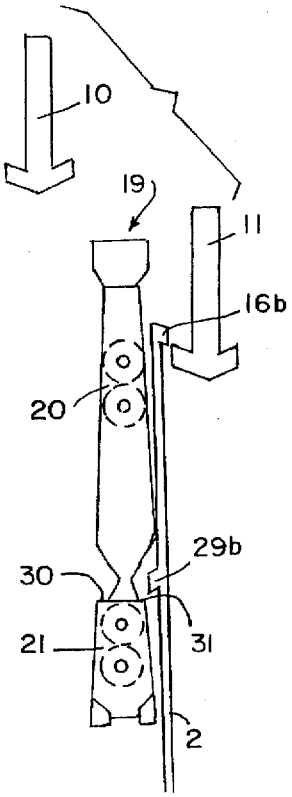
FIG. 11B
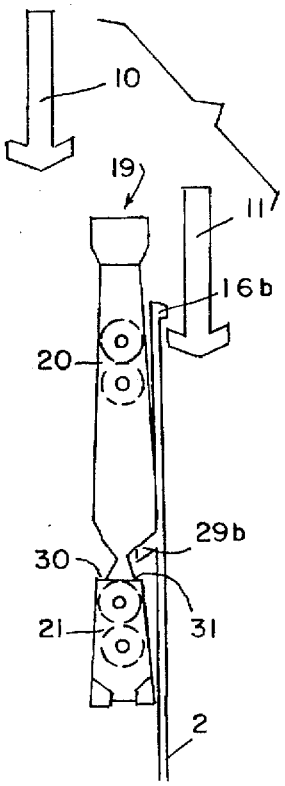
FIG. 11C FIG. 12A
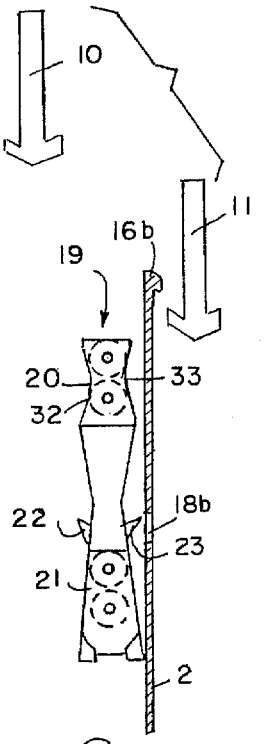
FIG. 12B
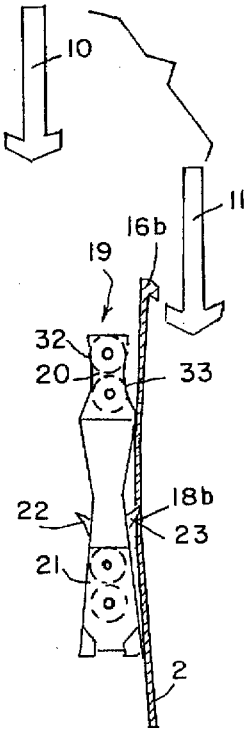
FIG. 12C
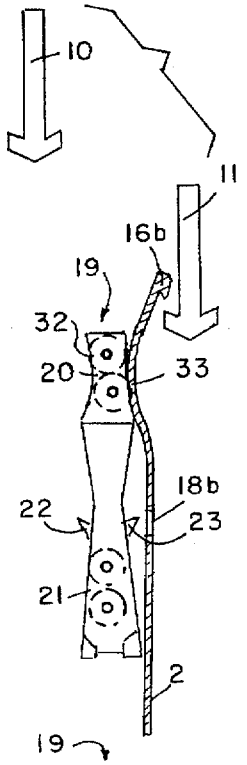
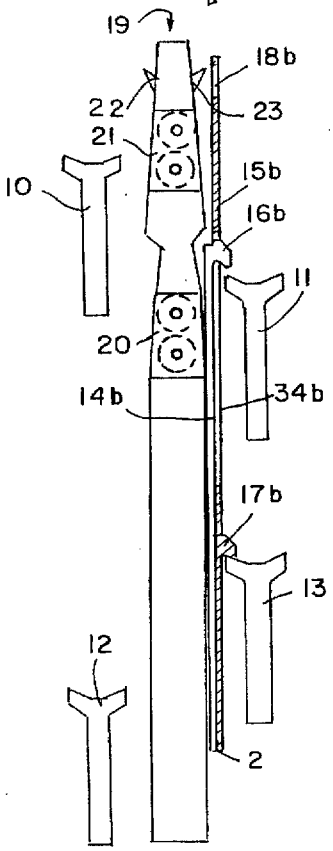
FIG. 13A
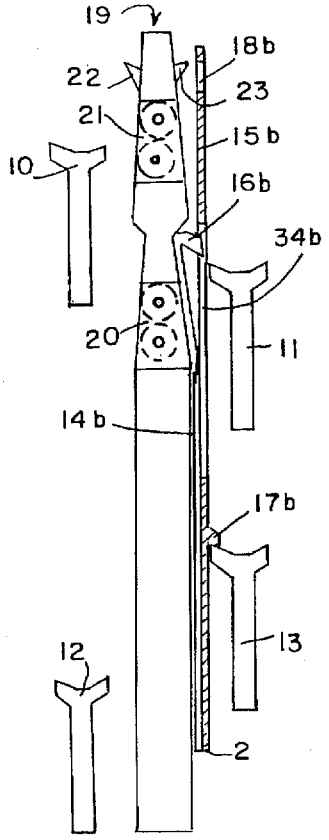
FIG. 13B
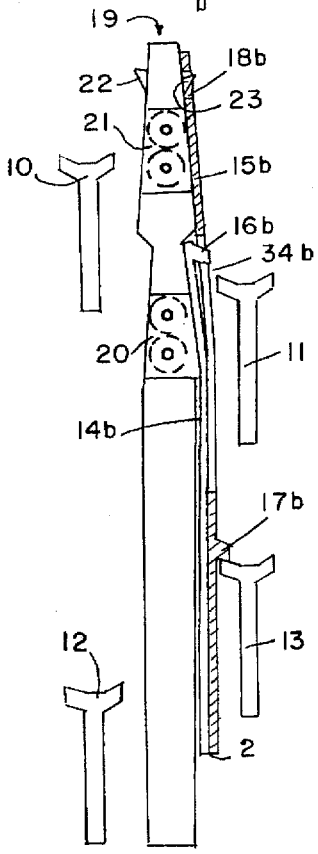
FIG. 13C

THREE-POSITION OPEN-SHED JACQUARD MACHINE

BACKGROUND OF THE INVENTION

The present invention relates to a three-position open-shed jacquard machine, comprising a system with two interacting hooks for lifting at least one warp thread on a weaving loom, two first hives which are movable up and down in counterphase (with a lift (hi)), provided in such a way that in a position in the vicinity of their bottom dead center they carry along a respective hook from a selection height, and a first control element, by means of which each hook is selectable at the selection height, so that a hook which has been selected can be carried along and a hook which has not been selected cannot be carried along by a first knife.

In the case of such a jacquard machine each system with two interacting hooks can take at least one warp thread to three different heights—hereinafter called positions. After each half movement cycle of the knives—which is whenever one of the knives is situated in its top dead center—one or more weft threads on the weaving loom are inserted into the shed formed between the warp threads. The insertion of one or more weft threads is hereinafter called a shot. In the case of a three-position open-shed jacquard machine the three positions of the warp threads can be achieved for each shot. This means that a warp thread which is situated in a first position for a particular shot can remain in said first position or be taken to the second position, or be taken to the third position for the next shot.

European Patent 0,399,930 discloses a three-position open-shed jacquard machine. In the case of this jacquard machine, in order to make the three positions possible, it is necessary to have a system with two sets of interacting hooks disposed adjacent to each other. The interacting hooks of each set are interconnected by means of a lifter cord. Each lifter cord is passed under a top lifter roller of a respective lifter element. Another lifter cord is immovably fixed by one end and is then passed under a bottom lifter roller of one lifter element, under a reversing roller which is immovably fixed lower down than the lifter elements on a fixed part of the jacquard machine, and over a bottom lifter roller of the other lifter element. The other end of said lifter cord is connected to a harness cord for lifting at least one warp thread. Through a suitable selection of the hooks, said warp thread can be taken optionally into one of three possible positions for each shot. A control element is necessary for each set of interacting hooks, in order to be able to make the desired selection.

Due to the fact that two adjacent sets of interacting hooks, two adjacent control elements, two lifter elements and a reversing roller are provided for each system, this jacquard machine takes up twice the amount of space of a two-position open-shed jacquard machine. Besides, this jacquard machine works out to be fairly expensive.

German Patent No. 4,101,778 discloses two three-position open-shed jacquard machines, with the characteristics indicated in the first paragraph of this description. Each system for lifting at least one warp thread to three different positions comprises two interacting hooks, one control element, and one lifter element.

In the case of the first jacquard machine each knife is provided with a carrier flange at two different heights, so that each hook can be carried along either by the top carrier flange or by the bottom carrier flange of a knife. When a knife is situated in its bottom dead center the top carrier flange is situated approximately at the level of the bent top end of a hook situated at the selection height.

At the moment when the bottom carrier flange is situated at the level of the bent top end of a hook said knife is already moving at full speed to its top dead center. When a hook has been selected to be carried along by the bottom carrier flange, said hook is carried along with a jerk by the knife from a stationary position to the selection height. This produces irregular running of the jacquard machine.

In the case of the second jacquard machine the knives have only one carrier flange. One of the two knives is connected to a transmission system in such a way that in its bottom dead center it goes to the same height as the other knife, but in its top dead center it is not lifted as high as the other knife.

The disadvantage of this jacquard machine lies particularly in the fact that a complex and expensive transmission system is required.

We look at two interacting hooks: hook I and hook II, their respective first knives: first knife I and first knife II, and their respective second knives: second knife I and second knife II.

Assuming that for a first shot first knife I is in its top dead center, then first knife II is in its bottom dead center, second knife I is in its bottom dead center, and second knife II is in its top dead center.

For this first shot hook I can be in situation a, b or c, and hook II can be in situation a', b' or c'. Hook I can thus be situated at the selection height (S) at height ($+h_1$), or at height ($-h_2$), while hook II is in any possible situation at the selection height (S).

For the positions of the interacting hooks there are thus three possibilities for the first shot:

Hook I and hook II at the selection height (S)

Hook I at height ($+h_1$) and hook II at the selection height (S)

Hook I at height ($-h_2$) and hook II at the selection height (S)

The end of the lifter cord which is connected to a harness cord for lifting at least one warp thread for these three possibilities is in a middle position, a highest position and a lowest position respectively. The one or more warp threads in this case are taken into a Middle, Top or Bottom position, indicated hereinafter by "M", "B" and "O" respectively.

On movement of the knives from their position for the first shot to their position for a subsequent, second shot the positions of the hooks can be retained or changed, either in order to keep the warp threads in the same position or to move them into one of the other two positions. This is achieved by making suitable selections before the knives move to their new positions, so that during the movement of the knives each hook is either retained at the selection height (S) or moves along with its first knife or its second knife.

For the second shot the positions of the knives are as follows:

first knife I: bottom dead center first knife II: top dead center second knife I: top dead center second knife II: bottom dead center If hook I was in situation a) for the first shot, this hook cannot be selected to move along with its first or its second knife. For in situation a) these knives are not in a position to carry along a hook which is at the selection height. For the second shot hook I is thus still at the selection height (S) in situation a').

If hook I was in situation b) for the first shot, it is carried along by its first knife to the selection height (S) in situation b'). For in situation b) no other selection of hook I can be made, since the hook is not at the selection height.

If hook I was in situation c) for the first shot, it is carried along by its second knife to the selection height (S) in situation c'). For in situation c') no other selection of hook I is possible, since the hook is not at the selection height.

For the second shot hook I is thus in any case at the selection height (S), irrespective of its situation for the first shot.

If hook II was in situation a') for the first shot, this hook can be as follows for the second shot:

either in situation a) (at the selection height (S)) through retention of the selection with the second control element.

or in situation b) (at height ($+h_1$)) through ending of the selection with the second control element and making a selection with the first control element.

or in situation c) (at height ($-h_2$) through ending of the selection with the second control element.

If hook II was in situation b') for the first shot, this hook can be as follows for the second shot:

either in situation a) (at the selection height (S)) through ending of the selection with the first control element and making a selection with the second control element.

or in situation b) (at height ($+h_1$)) through retention of the selection with the first control element.

or in situation c) (at height ($-h_2$) through ending of the selection with the first control element.

If hook II was in situation c') for the first shot, this hook can be as follows for the second shot:

either in situation a) (at the selection height (S)) through the making of a selection with the second control element.

or in situation b) (at height ($+h_1$)) through the making of a selection with the first control element.

or in situation c) (at height ($-h_2$) through making no selection with either of the two control elements.

From each possible situation for the first shot—by making the correct selections—hook II can thus be moved either to the selection height (S) or to the height ($+h_1$), or to the height ($-h_2$).

For the respective positions of the interacting hooks there are thus three possibilities in each case for the second shot:

Hook I and hook II at the selection height (S)

Hook I at the selection height (S) and hook II at the height ($+h_1$)

Hook I at the selection height (S) and hook II at the height ($-h_2$).

It follows from this that for the warp threads, irrespective of which of the three positions they are in for a first shot, each of the three positions can be achieved for a subsequent shot.

This jacquard machine has only one set of interacting hooks per system for lifting one or more warp threads. Per system only one lifter element is required, and two control elements are required, but they can be disposed in such a way, for example one below the other, that each system takes up no more space than a system with only one control element. Besides, no reversing roller is required.

On the one hand, this means that the jacquard machine according to this invention takes up only half the amount of space of the jacquard machine according to European Patent No. 0,399,930. On the other hand, this jacquard machine is also much less expensive and less complex than the jacquard machine known from the above-mentioned European patent.

The object of this invention is to provide a three-position open-shed jacquard machine which does not have the disadvantages indicated above.

SUMMARY OF THE INVENTION

This object is achieved according to this invention by providing a three-position open-shed jacquard machine having the characteristics indicated in the first paragraph of this description, the jacquard machine also comprising two second knives which are movable up and down in counterphase (with a lift $h_2$), provided for the purpose of carrying along a respective hook from the selection height when in a position in the vicinity of their top dead center, and a second control element, by means of which each hook is selectable at the selection height, so that a hook which has been selected is retained at the selection height, and a hook which has not been selected can be moved up and down, while a hook which has not been selected by either of the two control elements is carried along by a second knife, and the first and second knives interacting with the same hook are provided in such a way that they move in counterphase.

The system for lifting at least one warp thread comprises, for example, one lifter element with a top and a bottom lifter roller, while a lifter cord which connects the two hooks is passed under the top lifter roller, and another lifter cord is immovably fixed by one end, is then passed over the bottom lifter roller, and with the other end can lift one or more warp threads by means of a harness cord.

There follows an explanation of how with the jacquard machine according to this invention a warp thread can be moved into three different positions which are achievable for each shot.

Each hook can be in one of the following situations for a particular shot:

situation a): The hook is retained at the selection height (the reference height, indicated by (S)), while its first knife is in the top dead center and its second knife in the bottom dead center.

situation a'): The hook is retained at the selection height (S), while its first knife is in the bottom dead center and its second knife in the top dead center.

situation b): The hook is carried along by its first knife, while said first knife is in the top dead center, and its second knife is in the bottom dead center. The hook is at a height ($+h_1$) above the selection height.

situation b'): The hook is carried along by its first knife, while said first knife is in the bottom dead center, and its second knife is in the top dead center. The hook is at the selection height (S).

situation c): The hook is carried along by its second knife, while said second knife is in the bottom dead center, and its first knife is in the top dead center. The hook is at a height ($-h_2$) below the selection height.

situation c'): The hook is carried along by its second knife, while said second knife is in the top dead center, and its first knife is in the bottom dead center. The hook is at the selection height (S).

In the case of the jacquard machine according to this invention a hook can be carried along from the selection height (S) by a first knife if said knife is situated approximately in the bottom dead center, and by a second knife if said knife is situated approximately in the top dead center.

In these positions the speed of said knives is still relatively low, so that a hook can be carried along from a stationary position in a smooth and virtually jerk-free manner by its first and its second knife.

Moreover, this jacquard machine does not require an expensive and complex transmission system.

The disadvantages of the jacquard machines described in German Patent No. 4,101,778 are consequently also eliminated with the jacquard machine according to this invention.

In a special embodiment of the jacquard machine according to this invention the first and the second control elements are disposed one below the other. This means that these control elements take up the space of one control element in the breadthwise direction.

The first and second knives are preferably provided in such a way that each second knife is disposed below a respective first knife, and in its top dead center is in a position lower down than the first knife lying above it, in its bottom dead center.

Making a selection of a hook with the second control element and ending that selection is an extremely efficient operation by simple means if each hook has a retaining means by which at the selection height (S) it can hitch onto a respective retaining element disposed at a fixed height, while each hook at the selection height (S) can be moved into two different positions by the second control element, a hook in one position being hitched to its retaining element and in the other position not being hitched thereto.

The second control means and the hooks can also be designed very simply if the second control means for each hook comprises means for exerting a magnetic force upon the hook, while each hook situated at the selection height is elastically deformable by said magnetic force at the level of its retaining means, so that each hook can be taken into a deformed and a non-deformed position respectively by switching on and switching off the means provided for said hook, in one of the two positions the hook hitching onto and in the other position the hook not hitching onto its retaining element.

In a special embodiment of the jacquard machine according to this invention said retaining means is an opening provided in the hook, while the retaining element comprises a projection fitting into said opening. In another special embodiment the retaining means is a projection from the hook, while the retaining element comprises a supporting flange for said projection. In the case of this special embodiment both the hooks and the retaining elements are an extremely simple shape, and can thus be produced easily and cheaply.

A hook is selected by means of the first control element and said selection is ended in an extremely efficient manner and by simple means if each hook has a carrier means by means of which it can hitch onto a first knife in order to be carried along by said knife, while each hook at the selection height can be taken into two different positions by the first control element, and a hook in one position can be carried along, while in the other position it cannot be carried along by a first knife.

The first control means and the hooks can also be a very simple design if the first control means for each hook comprise means for exerting a magnetic force on the hook, while each hook situated at the selection height is elastically deformable by said magnetic force at the level of its carrier means, so that each hook can be taken into a deformed position and a non-deformed position respectively by switching on and switching off the means provided for said hook, and a hook in one of the two positions can be carried along, while in the other position it cannot be carried along by a first knife.

In a preferred embodiment the elastically deformable hooks described above have a flexible carrier strip with a carrier means and a flexible retaining strip with a retaining means, while the first control element can take the carrier strip of each hook situated at the selection height (S) into two different positions, and a hook in one position can be carried along, while in the other position it cannot be carried along by a first knife, and the second control element can take the retaining strip of each hook situated at the selection height (S) into two different positions, in which case a hook in one position hitches onto and in the other position does not hitch onto its retaining element.

The carrier strip and the retaining strip are preferably connected to each other and rest against each other along a certain length, and at the level of the carrier means and the retaining means are not connected to each other, so that at that position they can be moved into a bent position or spring back to their straight position independently of each other.

In a first special embodiment the carrier strip has a part projecting beyond one end of the retaining strip, on which part the carrier means is provided, while the retaining means is a projection provided on the retaining strip, and provision is made in the carrier strip for an opening, through which said projection can extend, in order to hitch onto a retaining element.

In a second special embodiment the retaining strip has a part projecting beyond one end of the carrier strip, on which part the retaining means is provided, while the carrier means is a projection provided on the carrier strip, and provision is made in the retaining strip for an opening, through which said projection can extend, in order to hitch onto a first knife.

In a variant embodiment of the jacquard machine according to this invention each hook has a retaining means by which at the selection height (S) it can hitch onto a respective retaining element, but it is not the hooks which can be moved into two different positions by the second control element. On the contrary, in this embodiment each retaining element can be taken into two different positions by the second control element, so that a hook situated at the selection height (S) in one position hitches onto its retaining element and in the other position does not hitch onto its retaining element.

In this variant embodiment each hook can also be provided with a carrier means by which it can hitch onto a carrier element of a respective first knife, while in the bottom dead center of the respective first knife each carrier element can be taken into two different positions by the first control element, so that a hook situated at the selection height (S) in one position can be carried along and in the other position cannot be carried along by its first knife.

Each first knife can also be provided with means for taking its carrier element into two different positions.

This invention is explained further in the description which follows of a number of possible embodiments of the jacquard machine according to this invention. In this description reference is made to the figures appended hereto, of which:

BRIEF DESCRIPTION OF THE DRAWINGS

FIGS. 3 to 5, are detailed views, inclusive in each case show a differently designed top end of a hook, opposite a first and a second control element and a retaining element.

FIGS. 6 to 9 inclusive in each case show a front view and a side view or a longitudinal section of the top end of an embodiment of a hook.

FIGS. 10A to 10C, 11A to 11C, 12A to 12C and 13*a* to 13*c* inclusive in each case show the top end view of a hook, opposite a first and a second control element and a retaining element, the hook being designed differently in each group of three figures and the respective figures of each group showing the hook for a different selection.

DETAILED DESCRIPTION OF PREFERRED EMBODIMENTS

Figures 1A, 1B, 1C, 1D:
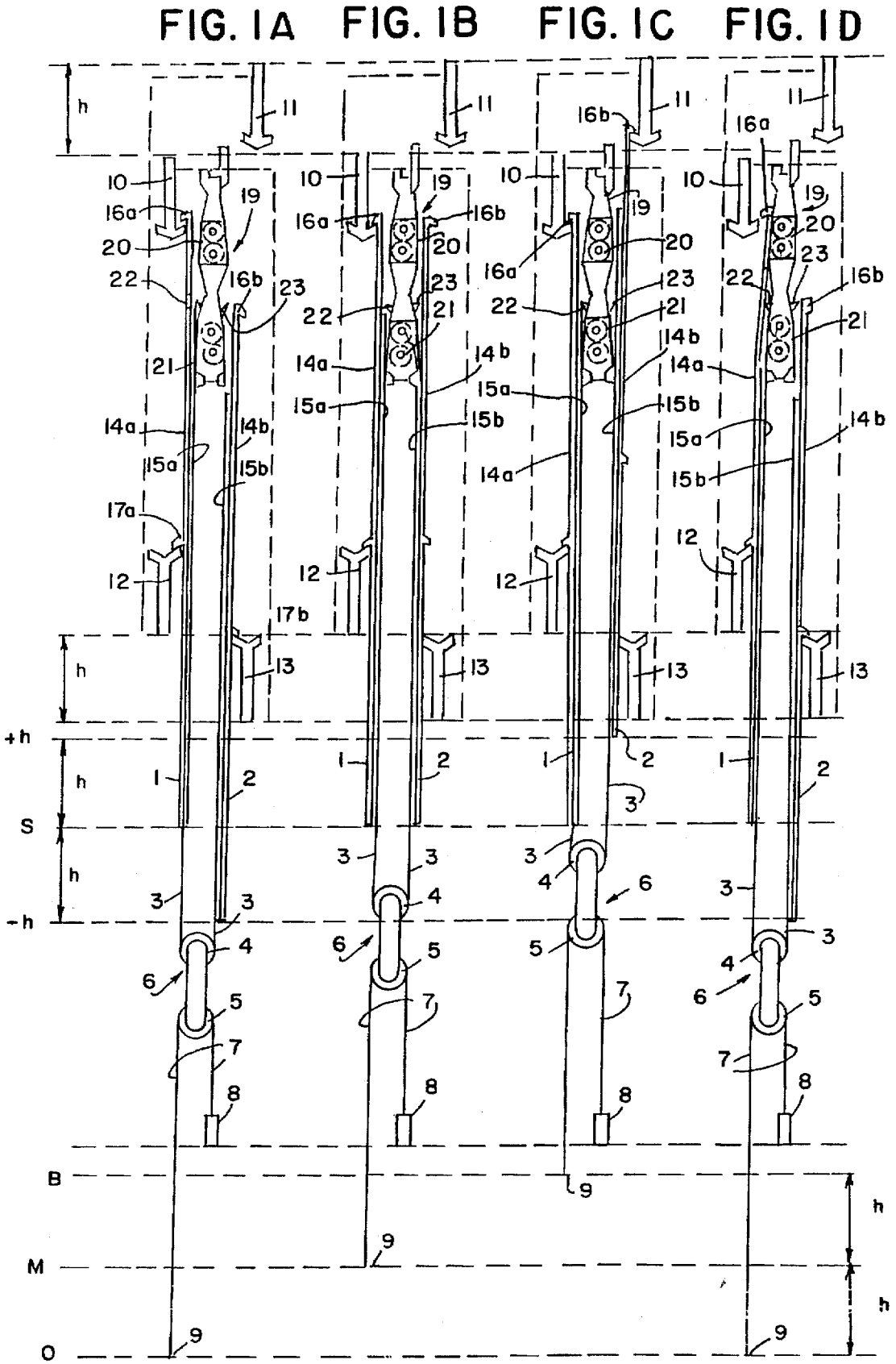
FIGS. 1A to 1D, are perspective views, inclusive in each case for a first shot show the first and second knives, a first and a second control element and two interacting hooks of a system for lifting warp threads, the hooks being shown for a different selection in each figure.
Figures 2A, 2B, 2C, 2D:
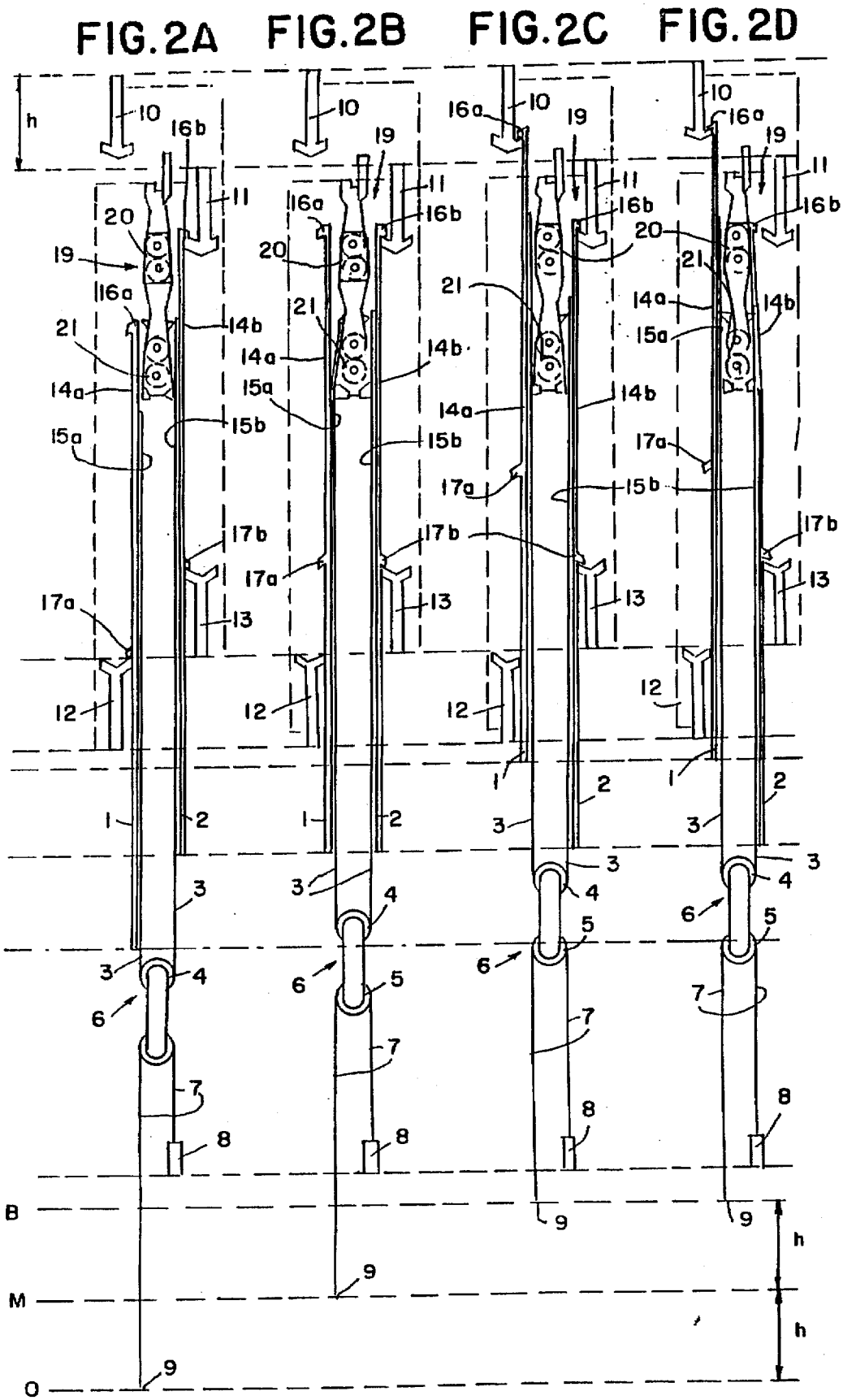
FIGS. 2A to 2D, are perspective views, inclusive in each case for a second shot show the same parts as in FIGS. 1A to 1D inclusive, the hooks being shown for a different selection in each figure.

A possible embodiment of a jacquard machine according to this invention has (see FIGS. 1A to 1D inclusive and 2A to 2D inclusive) a system for lifting at least one warp thread on a weaving loom, comprising two interacting hooks (1), (2), a lifter cord (3) which is connected to both hooks (1), (2) and passed under the top roller (4) of a lifter element (6), and another lifter cord (7) which is fixed by one end in a fixed point (8), is passed over the bottom roller (5) of the lifter element (6), and is connected by the other end (9) to one or more harness cords for lifting one or more warp threads (not shown in the figures). The position of the latter lifter cord end (9) determines the position of the one or more warp threads on the weaving loom. Each of the three possible positions of the lifter cord end (9) is indicated in the figure by the corresponding position B, M or O (top, middle or bottom respectively) of the warp threads.

This jacquard machine also has two first knives (10), (11) which are movable up and down in counterphase (by a drive unit which is not shown) with a lift (h), and below each first knife (10), (11) a second knife (12), (13). The second knives (12), (13) can also be moved up and down in counterphase (by a drive unit which is not shown) with a lift (h), and each second knife (12), (13) also moves in counterphase relative to the first knife (10), (11) lying above.

If a first knife (10), (11) is in its bottom (top) dead center, the second knife (12), (13) disposed below said first knife (10), (11) is consequently in its top (bottom) dead center position. In FIGS. 1A to 1D and 2A to 2D inclusive the knives (10), (11), (12), (13) moving mutually in phase are connected by a dashed line.

A second knife (12), (13) in its top dead center lies lower down than the first knife (10), (11) above it in its bottom dead center.

Each hook (1), (2) comprises two flat flexible metal strips (14*a*), (15*a*); (14*b*), (15*b*) of different lengths. Both strips (14*a*), (14*b*); (15*a*), (15*b*), called the carrier strip (14*a*), (14*b*) and the retaining strip (15*a*), (15*b*) respectively, are connected to each other, resting against each other, along a certain length from their underside and have a top part where they are not connected to each other, so that each strip (14*a*), (14*b*); (15*a*), (15*b*) at that point can be taken into a bent position and can spring back independently of the other strip.

The carrier strip (14*a*), (14*b*) has a part which projects beyond the top end of the retaining strip (15*a*), (15*b*) and has a top hook-shaped end (16*a*), (16*b*), by means of which the hook (1), (2) can hitch onto a first knife (10), (11), so that it can be carried along by said first knife (10), (11). About halfway up, the carrier strip (14*a*), (14*b*) is provided with a supporting lug (17*a*), (17*b*), by means of which the hook (1), (2) can rest on a second knife (12), (13), so that the hook (1), (2) can be carried along by said second knife (12), (13).

As indicated in FIG. 3, in the vicinity of its top end the retaining strip (15*a*), (15*b*) is provided with an opening (18*a*), (18*b*), the use of which will be explained later on in this description.

This jacquard machine also has a selection device (19) which is disposed at a fixed height, and in which below one another a first (20) and a second control element (21) are accommodated. As was indicated in FIG. 3, each control element (20), (21) comprises two coils (20'), (20"); (21'), (21") by means of which an electromagnetic field can be created in the known manner. The selection device (19) is also provided on either side with a hook-shaped projection (22), (23), which fits into the abovementioned opening (18*a*), (18*b*) of the retaining strip (15*a*), (15*b*).

The hooks (1), (2) are disposed next to each other with their retaining strips (15*a*), (15*b*) facing each other, so that each hook (1), (2) can hitch with its top hook-shaped ends (16*a*), (16*b*) onto a respective first knife (10), (11) or can rest with its supporting lug (17*a*), (17*b*) on a respective second knife (12), (13).

A hook (1), (2) carried along by a first knife (10), (11) is taken to the selection height (S) if this first knife (10), (11) is in its bottom dead center. A hook (1), (2) carried along by a second knife (12), (13) is taken to the selection height (S) if this second knife (12), (13) is in its top dead center.

The selection device (19) is disposed in such a way between the interacting hooks that the hooks (1), (2) taken to the selection height (S) are situated with the top part of their carrier strip (14*a*), (14*b*) at the level of the first control element (20) and are situated with the top part of their retaining strip (15*a*), (15*b*) at the level of the second control element (21).

Each control element (20), (21) has coils (20'), (20"), (21'), (21") for exerting an electromagnetic force on both hooks (1), (2).

These coils (20'), (20"), (21'), (21") are controlled automatically by means of a control device not shown in the figures.

When the first control element (20) exerts a magnetic force on a hook (1), (2) which is situated at the selection height (S), the carrier strip (14*a*), (14*b*) of said hook (1), (2) is bent in the direction of the selection device (19), so that the hook-shaped end (16*a*), (16*b*) of said carrier strip (14*a*), (14*b*) goes out of the range of the first knife (10), (11) provided for said hook (1), (2). This is the case for the left-hand hook (1) in FIG. 1D.

When the first control element (20) no longer exerts a magnetic force on said hook (1), (2), the carrier strip (14*a*), (14*b*) springs back to its straight position, so that the hook-shaped end (16*a*), (16*b*) of said carrier strip (14*a*), (14*b*) can hitch onto the first knife (10), (11) provided for said hook (1), (2). This is the case for the left-hand hooks (1) in FIGS. 1A, 1B and 1C.

When the second control element (21) exerts a magnetic force on a hook (1), (2) which is at the selection height (S), the retaining strip (15*a*), (15*b*) of said hook (1), (2) is bent in the direction of the selection device (19), so that the hook-shaped projection (22), (23) of the selection device (19) goes into the opening (18*a*), (18*b*) of the retaining strip (15*a*), (15*b*). In this way the hook (1), (2) is retained at the selection height (S). This is the case for the right-hand hook (2) in FIG. 1B.

When the second control element (21) no longer exerts a magnetic force on said hook (1), (2), the retaining strip (15*a*), (15*b*) springs back to its straight position, so that the hook-shaped projection (22), (23) of the selection device (19) leaves the opening (18*a*), (18*b*) of the retaining strip (15*a*), (15*b*). The hook (1), (2) can then move freely up and down again. This is the case for the right-hand hook (2) in FIG. 1C and for the left-hand hook (1) in FIGS. 1A to 1D inclusive.

In the embodiment shown in FIGS. 1A to 1D and 2A to 2D inclusive a hook (1), (2) is consequently selected by the first control element (20) by not exerting any magnetic force, and is selected by the second control element (21) by exerting a magnetic force thereon.

Various positions of the hooks (1), (2) are shown in FIGS. 1A to 1D inclusive for a first shot, during which the left-hand first knife (10) is situated in its bottom dead center. The right-hand first knife (11) is thus in its top dead center, while the left-hand (12) and the right-hand second knife (13) are in the top and the bottom dead center respectively.

In FIG. 1A both hooks (1), (2) are supported by their respective second knife (12), (13), so that the left-hand hook (1) is at the selection height (S) and the right-hand hook (2) at the height (–h). The lifter cord end (9) is then situated in the position "O". The left-hand hook (1) is selected by the first control element (20).

In FIG. 1B the left-hand hook (1) is supported at the selection height (S) by its second knife (12), and the right-hand hook (2) is retained at the selection height (S) through a selection with the second control element (21). The lifter cord end (9) is then situated in the position "M". The left-hand hook (1) is selected by the first control element (20).

In FIG. 1C the left-hand hook (1) is supported at the selection height (S) by its second knife (12), and the right-hand hook (2) at the height (-h) is carried along by its first knife (11). The lifter cord end (9) is then situated in the position "B". The left-hand hook (1) is selected by the first control element (20).

FIG. 1D differs from FIG. 1A only through the fact that the left-hand hook (1) has not been selected by the first supporting element (20). The lifter cord end (9) is thus also situated in the position "O" here.

By making the correct selections it is possible from each of the three possible positions "B, M, O" of the lifter cord end (9) for a first shot in each case either to retain the position of the first shot or to reach the other two positions for a subsequent (second) shot.

From the situations (position "O") shown in FIGS. 1A and 1D the three possible positions "B, M, O" can be reached as follows for the next shot:

If the left-hand hook (1) is selected only with the first control element (20), said hook (1) is carried along by the left-hand first knife (10) to the top dead center. Said hook (1) is thus lifted a distance (h) higher to the height (+h). The right-hand hook (2) remains supported by the right-hand second knife (13) and is carried along by said knife (13) to the top dead center. This hook (2) is thus also lifted a distance (h) higher to the height (S). The lifter cord end (9) is consequently lifted a distance (2h) higher, so that the position "B" is reached (see FIG. 2C).

If the left-hand hook (1) is not selected with either of the control elements (20), (21), said hook (1) is carried along by the left-hand second knife (12) to the bottom dead center. Said hook (1) is thus lowered a distance (h) to the height (–h). As explained above, the right-hand hook (2) is lifted a distance (h) higher to the height (S). The lifter cord end (9) thus remains in the position "O" (see FIG. 2A).

If the left-hand hook (1) is selected only with the first control element (21), said hook (1) is retained at the selection height (S). As explained above, the right-hand hook (2) is lifted a distance (h) higher to the selection height (S). The lifter cord end (9) is consequently lifted a distance (h) higher, so that the position "M" is reached (see FIG. 2B).

From the situation illustrated in FIG. 1B (position "M") it can be demonstrated in a similar way that the three possible positions "B, M, O" can be achieved for the following shot. The right-hand hook (2) in each case remains at the selection height (S), and if the left-hand hook (1) is selected only with the first control element (20), the position "B" is reached;

if the left-hand hook (1) is selected only with the second control element (21), the position "M" is retained;

if the left-hand hook (1) is not selected with either of the control elements (20), (21), the position "O" is reached.

The three positions can also be reached from the situation (position "B") shown in FIG. 1C. While the right-hand hook (2) is lowered a distance (h) (to the selection height (S)) by its first knife (11), the position "B" can be retained by selecting the left-hand hook (1) only with the first control element (20), the position "M" can be reached by selecting the left-hand hook (1) only with the second control element (21), and the position "O" can be reached by not selecting the left-hand hook (1) with either of the two control elements.

From each of the different situations (for a second shot) shown in FIGS. 2A to 2D inclusive the three possible positions can also be reached for a subsequent (third) shot. There it is the left-hand hook (1) in each case which is taken to the selection height (S) or held there on movement of the knives (10), (11), (12), (13) to their positions for a third shot. If the right-hand hook (2) is selected only with the first control element (20), the position "B" is retained or reached. If the right-hand hook (2) is selected only with the second control element (21), the position "M" is retained or reached. If the right-hand hook (2) is not selected with either of the two control elements (20), (21), the position "O" is retained or reached.

In FIG. 3 a selection device (19), two first knives (10), (11) and the top end of two interacting hooks (1), (2) according to FIGS. 1A to 1D and 2A to 2D inclusive are shown on a larger scale. A front view and a side view of such a hook (1) are shown in FIG. 6.

However, the hooks (1), (2) and the selection device (19) can also be designed differently.

As shown in FIG. 4 (only the right-hand hook (2) is shown), the retaining strip (15*a*), (15*b*) can have a hook-shaped top end (24*a*), (24*b*) which faces away from the selection device (19) and can extend through an opening (25*a*), (25*b*) in the carrier strip (14*a*), (14*b*), in order to hitch onto a retaining element (26), (27) which is disposed at a fixed height and does not form part of the selection device (19). Such a hook (1), (2) is selected by the second control element (21) when said control element (21) exerts no magnetic force on the retaining strip (15*a*), (15*b*).

As shown in FIG. 5 (only the right-hand hook (2) is shown), the retaining strip (15*a*), (15*b*) according to another embodiment can be provided with a hook-shaped top end (28*a*), (28*b*) which faces the selection device (19) and can hitch onto a projection (22), (23) provided on the selection device (19).

FIG. 7 shows a front view and a longitudinal section of a hook (1), consisting of one flat flexible strip, a rectangular part of which is partially cut out in the lengthwise direction, so that said part remains connected only by its bottom side to the strip.

At the top the strip has a hook-shaped end (16*a*), so that the top part of the strip forms the carrier strip (14*a*). The cut-out part is provided with an opening (18*a*) or with a hook-shaped top end (28*b*)—as in the case of the hook in FIG. 5—so that this part forms the retaining strip (15*a*).

FIG. 8 shows a front view of a hook (1) according to FIG. 4, a longitudinal section of said hook (1) in a non-deformed position, and a longitudinal section of said hook (1) in the position which it assumes when the second control element (21) exerts a magnetic force on the retaining strip (15*a*). (In that position the hook (1) has not been selected by the second control element (21) and thus does not hitch onto the retaining element (26)).

FIG. 9 shows a front view and a longitudinal section of a hook (1) according to FIG. 5.

The hooks (1), (2) can also consist of one flexible strip which at the top has a hook-shaped end (16*a*), (16*b*) by means of which it can hitch onto a first knife (10), (11), and lower down an opening (18*a*), (18*b*), by means of which it can hitch onto a projection (22), (23) of the selection device (19).

In FIGS. 10A to 10C inclusive one such hook (2) is shown, selected only by the first control element (20), selected by neither of the two control elements (20), (21), and selected only by the second control element (21) respectively.

Instead of an opening (18*a*), (18*b*) in the hook (1), (2) and a projection (22), (23) on the selection device (19), each hook (1), (2) can also be provided with a projection (29*a*), (29*b*), while the selection device (19) has on either side a supporting flange (30), (31) for the respective projections (29*a*), (29*b*) of the respective hooks (1), (2).

In FIGS. 11A to 11C inclusive one such hook (1) is shown, selected only by the first control element (20), selected by neither of the two control elements (20), (21), and selected only by the second control element (21) respectively.

According to yet another embodiment (see FIGS. 12A to 12C inclusive), the selection device (19) can have a concave side wall (32), (33) on either side at the level of the first control element (20). A hook (1), (2) on which a magnetic force is exerted by the first control element (20) is pulled with a part situated in the vicinity of the top end against a concave side wall (32), (33), so that the part of the hook (1), (2) situated above the part pulled against the concave side wall (32), (33) is bent away from the selection device (19). Each hook (1), (2) has a top hook-shaped end (16*a*), (16*b*), with which it can hitch onto a first knife (10), (11), and lower down an opening (18*a*), (18*b*) or a projection (29*a*), (29*b*) by means of which it can hitch on at the selection height (S). If the first control element (20) exerts no magnetic force on a hook (1), (2), said hook cannot be carried along by a first knife (10), (11) (and the hook is thus not selected). If the first control element (20) does exert a magnetic force on a hook (1), (2), the hook-shaped end (16*a*), (16*b*) comes within the range of a first knife (10), (11) (as shown clearly in FIG. 12C), and the hook (1), (2) can then be carried along by a first knife (10), (11) (and so the hook (1), (2) is then selected).

In FIGS. 12A to 12C inclusive one such hook (2) is shown, selected by neither of the two control elements (20), (21), selected only by the second control element (21), and selected only by the first control element (20) respectively.

For the hooks (1), (2) consisting of a single strip shown in FIGS. 10A to 10C, 11A to 11C and 12*a* to 12*c* inclusive the control elements (20), (21) must be provided with adequate spacing between them to permit fluent bending of the hooks (1), (2) at the level of the second control element.

In another embodiment each hook (1), (2), as described above, can consist of a carrier strip (14*a*), (14*b*) and a retaining strip (15*a*), (15*b*), while the retaining strip (15*a*), (15*b*) has a part which projects beyond the top end of the carrier strip (14*a*), (14*b*) and in which an opening (18*a*), (18*b*) is provided. The carrier strip (14*a*), (14*b*) is provided with a hook-shaped top end (16*a*), (16*b*) which can extend through an opening (34*a*), (34*b*) in the retaining strip (15*a*), (15*b*), so that it hitches onto a first knife (10), (11). The retaining strip (15*a*), (15*b*) is provided with a supporting lug (17*a*), (17*b*), by means of which the hook (1), (2) can rest on a second knife (12), (13).

In the case of this embodiment the second control element (21) is situated above the first control element (20) in the selection device (19), while the projections (22), (23) are, of course, provided at the level of the second control element (21).

In FIGS. 13A to 13C inclusive the hook (2) is selected only by the first control element (20), is selected by neither of the two control elements (20), (21), and is selected only by the second control element (21) respectively.

According to yet another embodiment (see FIGS. 14A to 14C inclusive), the first knives (10), (11) are provided with respective downward directed flexible carrier arms (35), (36) which at the bottom have a hook-shaped end (35'), (36'). Both at the level of the first control element (20) and at the level of the second control element (21) the selection device (19) has two side walls (37), (38); (39), (40) running downwards towards each other. Two downward directed flexible retaining arms (41), (42) are fixed on the selection device (19) opposite the side walls (39), (40) at the level of the second control element (21). Each retaining arm (41), (42) has at the bottom a hook-shaped end (41'), (42'), and can be pulled by the second control element (21) against a respective abovementioned wall (39), (40), at the level of the second control element (21) (see, for example, the right-hand retaining arms (42) in FIGS. 14A and 14B) through the exertion of a magnetic force by means of one of the coils (21'), (21"). A retaining arm (41), (42) on which no magnetic force is exerted springs back to its vertical position (see the right-hand retaining arm in FIG. 14C).

In the bottom dead center of the first knives (10), (11) the carrier arms (35), (36) are situated opposite the respective abovementioned side walls (37), (38) at the level of the first control element (20). In that position each carrier arm (35), (36) can be pulled by the first control element (20) against a respective wall (37), (38) (see right-hand carrier arms (36) in FIGS. 14B and 14C) through the exertion of a magnetic force by means of one of the coils (20'), (20"). A carrier arm (35), (36) on which no magnetic force is exerted springs back to a vertical position (see right-hand carrier arm in FIG. 14A).

The hooks (1), (2) consist of straight metal strips, which do not necessarily have to be flexible. Each hook (1), (2) has a supporting lug (17*a*), (17*b*), a carrier opening (18*a*), (18*b*) and a retaining opening (38*a*), (38*b*).

A hook (1), (2) situated at the selection height is selected by the first control element (20) if its first knife (10), (11) is situated in its bottom dead center, and if the first control element (20) exerts no magnetic force on the carrier arm (30), (31) of said first knife (10), (11). For the hook-shaped end of the carrier arm (30'), (31') is then situated in the carrier opening (18*a*), (18*b*) of the hook (1), (2), so that the hook (1), (2) is carried along by its first knife (10), (11). If a magnetic force is exerted, then the hook (1), (2) is not selected.

A hook (1), (2) situated at the selection height (S) is selected by the second control element (21) if no magnetic force is exerted by the second control element (21) on the retaining arm (41), (42) opposite said hook (1), (2). For the hook-shaped end of the retaining arm (41'), (42') is then situated in the retaining opening (18*a*), (18*b*) of the hook (1), (2), so that the hook (1), (2) is retained at the selection height (S).

Figure 14A:
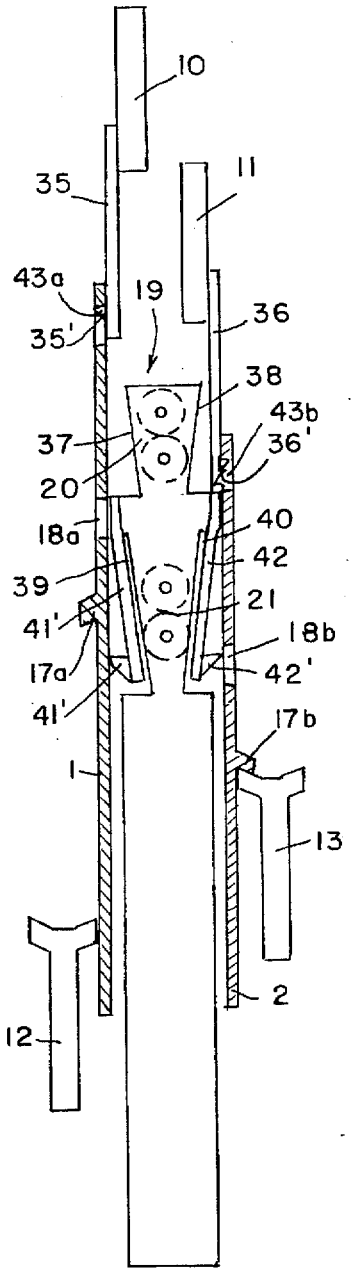
FIGS. 14A to 14C inclusive and 15A to 15C inclusive in each case show the first and second knives, a first and a second control element and two interacting hooks, the retaining elements being movable by the second control element, and carrier elements of the first knives being movable by the first control element, while the control elements are different in each group of three figures, and the respective figures of each group show the hooks for a different selection.
Figure 14B:
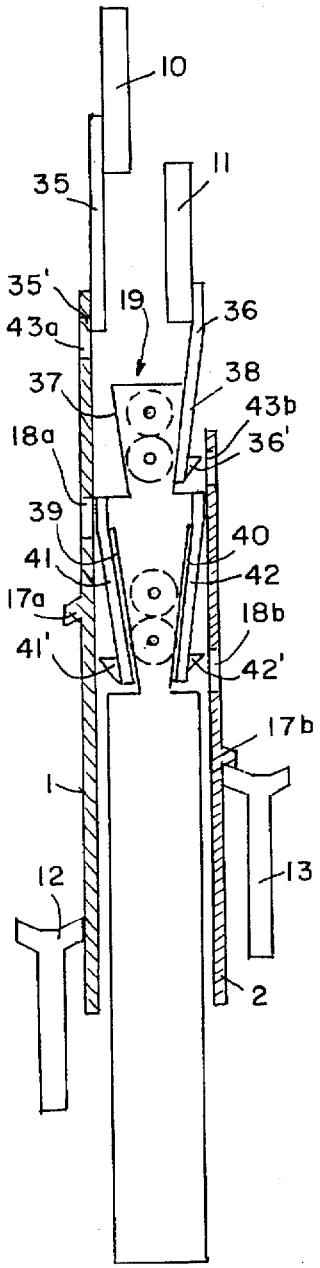
Figure 14C:
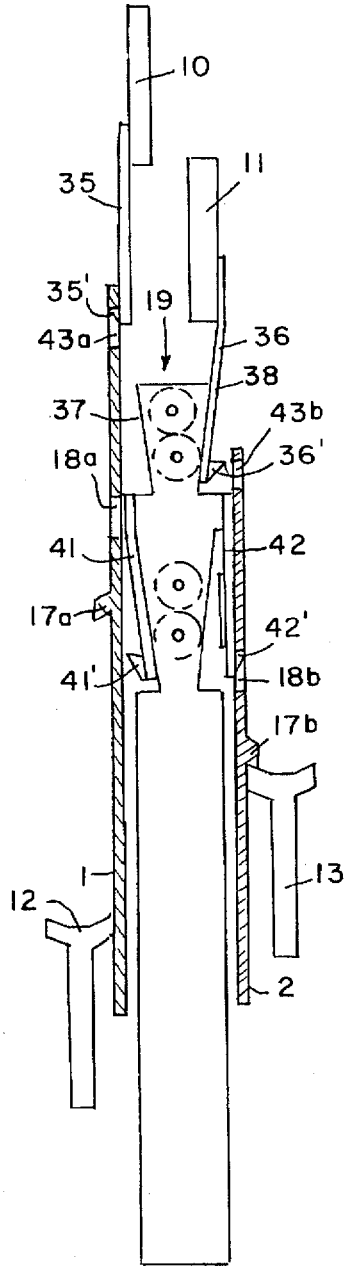

In FIGS. 14A to 14C inclusive the left-hand hook (1) is in each case carried along by the first knife (10) situated in its top dead center, while the right-hand hook (2) at the selection height is selected only by the first control element (20), is selected by neither of the two control elements (20), (21), and is selected only by the second control element (21) respectively.

According to yet another embodiment (see FIGS. 15A to 15C inclusive), the hooks (1), (2) are designed according to FIGS. 14A to 14C inclusive. The carrier arms (35), (36) hingedly fixed to the knives (10), (11) can be taken into two different positions by means of bistable elements (43), (44); (45), (46), which are provided on each first knife (10), (11). In one position a carrier arm (35), (36) can carry along a hook (1), (2), while in the other position it cannot (see the right-hand carrier arm (36) in FIG. 15B and the right-hand carrier arm (36) in FIG. 15A respectively). The selection device (19) contains only the second control element (21) and two hingedly fixed retaining arms (41), (42).

Each retaining arm (41), (42) can be taken into two different positions by means of bistable elements (47), (48); (49), (50). In one position a retaining arm (41), (42) can retain a hook (1), (2) at the selection height (S), while in the other position it cannot (see the right-hand retaining arm (42) in FIG. 15C and the right-hand retaining arm (42) in FIG. 15A respectively).

Figure 15A:
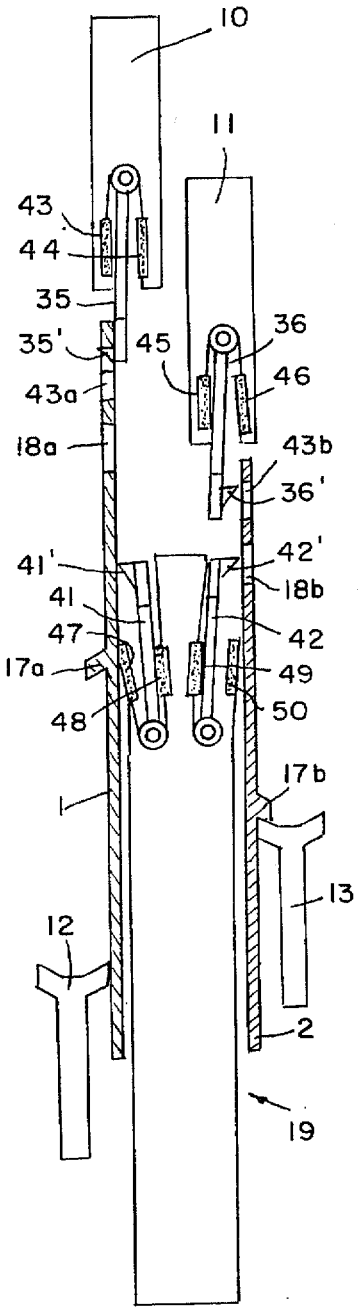
Figure 15B:
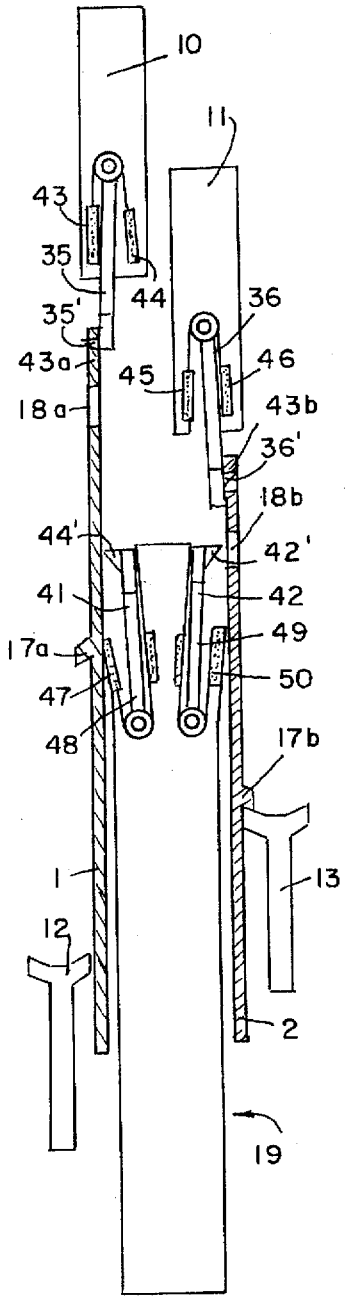
Figure 15C:
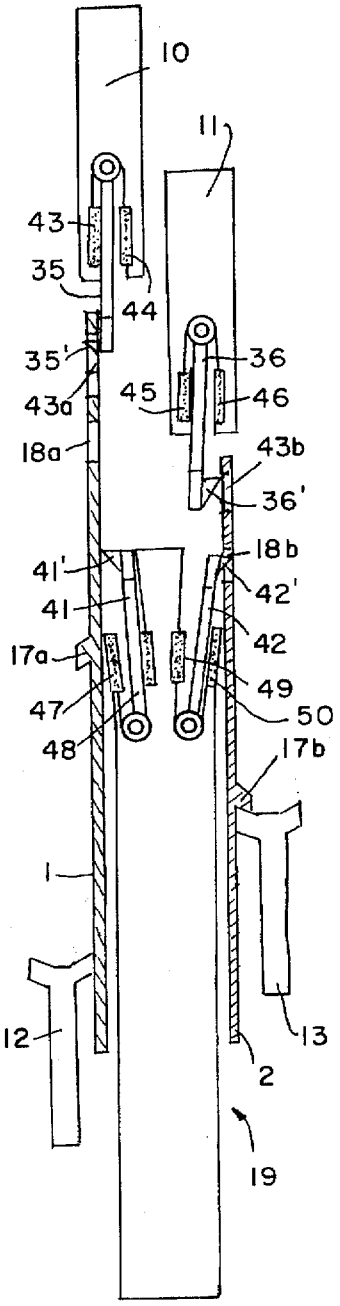

In FIGS. 15A to 15C the left-hand hook (1) in each case is carried along by the first knife (10), situated in its top dead center, while the right-hand hook (2) at the selection height (S) is selected by neither of the two control elements (20), (21), is selected only by the first control element (20), and is selected only by the second control element (21) respectively.

Only the top part of the hooks (1), (2) in each case is shown in FIGS. 3 to 12C inclusive. These hooks (1), (2) are, of course, also provided with a supporting lug (17*a*), (17*b*) on the lower part (not shown).

According to this invention a three-position open-shed jacquard machine with a division of one control element is obtained, so that the jacquard machine remains limited in dimensions. Moreover, the hooks (1), (2) are carried along without jerking from the selection height (S). In addition, only one lifter element (6) is required.

By controlling a grate to which the end (8) of the lifter cord (17) is attached, it is also possible to construct a jacquard machine with 3, 4 or 5 positions, in which three positions are available in each case for each shot. A top shed and bottom shed can be set differently by giving the first knives (10), (11) and the second knives (12), (13) a difference in lift.

I claim:

1. Three-position open-shed jacquard machine, comprising a system with two interacting hooks for lifting at least one warp thread on a weaving loom, a first control element for controlling selection of each hook from a selection height, first and second knives movable up and down in counterphase between respective top and bottom positions, the first and second knives picking a respective hook selected by the first control element from a selection height in the bottom position, a second control element for controlling selection of each hook from the selection height, third and fourth knives movable up and down in counterphase between respective top and bottom positions, the third and fourth knives picking a respective hook from the two hooks not selected by the first and second control elements from the selection height in the top position, wherein each hook selected by the second control element is retained at the selection height, and wherein the first and second knives and the third and fourth knives are adapted to move in counterphase.

2. The jacquard machine of claim 1, wherein the first and the second control elements are disposed one below another.

3. The jacquard machine of claim 1, wherein each of the third and fourth knives is disposed below the respective first and second knives, and wherein each top position of the third and fourth knives lies below each bottom position of the first and second knives.

4. The jacquard machine of claim 1, further comprising plural retainers on each of the two hooks, plural retaining elements provided at fixed heights on the machine wherein the retainers hitch onto corresponding retaining elements, and each hook being movable to at least two positions at the selection height by the second control element, the retainers of the hooks being hitched to the respective retaining elements in one position and being released from the retaining elements in another position.

5. The jacquard machine of claim 1, further comprising retaining means provided on the second control element for exerting a magnetic force upon the hooks, each hook being elastically deformable by said magnetic force, and each hook being movable between a deformed position and a non-deformed position respectively by activating and deactivating the retaining means for hitching and unhitching the respective hook on the retaining elements.

6. The jacquard machine of claim 5, wherein the retaining means is an opening provided on each hook, and projections provided on each retaining element for engaging said opening.

7. The jacquard machine of claim 5, wherein the retaining means is a projection from each hook, and supporting flanges provided on each retaining element for engaging the projection.

8. The jacquard machine of claim 4, further comprising a carrier means on each hook for engaging the first and second knives for allowing the control element to move the hooks between two different positions, whereby one hook in one position is carried along by the respective first and second knives and in another position it is not carried along by the respective first and second knives.

9. The jacquard machine of claim 8, further comprising means provided on the first control element for exerting a magnetic force on the hooks, each hook being elastically deformable by said magnetic force at a hook level of the carrier means between deformed and non-deformed positions respectively by switching on and switching off the means whereby the hook in one position is carried along and in another position it is not carried along by the first and second knives.

10. The jacquard machine of claim 4, further comprising a flexible carrier strip with a carrier means on each hook, the carrier strip of each hook engaging the first control element to position the hooks in two different positions, whereby the hook is carried along in one position and in another position the hook is not carried along by the first and second knives, and further comprising a flexible retaining strip with a retaining means on each hook, the retaining strip engaging the second control element to position the hooks at two different positions, whereby in one position the hook engages the retaining element and in another position does not engage the retaining element.

11. The jacquard machine of claim 10, wherein the carrier strip is connected to the retaining strip and a length of the carrier strip and the retaining strip are positioned adjacent each other, and wherein the carrier strip and the retaining strip are not connected to each other at a level of the carrier means and the retaining means to move the carrier means and the retaining means between straight and bent positions independently of each other.

12. The jacquard machine of claim 10, further comprising a projection on the carrier strip for positioning the carrier means, and wherein the retaining means is a projection provided on the retaining strip, and opening on the carrier strip for receiving the projection of the retaining strip to engage the retaining element.

13. The jacquard machine of claim 10, further comprising a projection on the retaining strip for positioning the retaining means, and wherein the retaining means is a projection provided on the carrier strip, an opening on the retaining strip for receiving the projection to engage the first and second knives.

14. The jacquard machine of claim 1, further comprising a retaining means on each hook at the selection height and retaining elements on the second control element, the retaining means engaging a respective retaining element, wherein each retaining element is movable between two different positions by the second control element whereby a hook situated at the selection height in one position engages the respective retaining element and in the other position does not engage the respective retaining element.

15. The jacquard machine of claim 1, further comprising carrier means on each hook, carrier elements on the first and second knives, the carrier means engaging a carrier element of a respective first and second knives and wherein at the bottom position of the respective first and second knives each carrier element is movable to two different positions by the first control element, whereby a hook positioned at the selection height in one position is carried along and in another position is not carried along by the first and second knives.

* * * * *